United States Patent [19]

Alba et al.

[11] Patent Number: 4,711,389

[45] Date of Patent: Dec. 8, 1987

[54] SELF-SUPPORTING AND SPILL RESISTANT FOOD CARTON

[75] Inventors: Andrew J. Alba, Warwick; James A. Griesemer, Campbell Hall; Robert L. Gordon, Monroe, all of N.Y.

[73] Assignee: International Paper Company, Purchase, N.Y.

[21] Appl. No.: 906,585

[22] Filed: Sep. 9, 1986

Related U.S. Application Data

[63] Continuation of Ser. No. 807,891, Dec. 11, 1985, abandoned.

[51] Int. Cl.[4] ..... B65D 5/18

[52] U.S. Cl. ..... 229/1.5 B; 229/8; 229/16 A; 229/DIG. 14; 229/120

[58] Field of Search ..... 229/1.5 B, 8, 41 D, 229/21, DIG. 14, 16 A, 120; 206/519, 520

[56] References Cited

U.S. PATENT DOCUMENTS

| | | | |
|---|---|---|---|
| 904,050 | 11/1908 | Crawford | 229/21 |
| 1,968,660 | 7/1934 | Towell | 229/41 D |
| 1,968,661 | 7/1934 | Towell | 229/41 D |
| 2,078,038 | 4/1937 | Stephens | 229/41 |
| 2,288,205 | 6/1942 | Paige | 229/41 D |
| 2,384,974 | 6/1945 | Smith | 150/2 |
| 2,688,914 | 6/1954 | Eckler | 100/211 |
| 2,964,227 | 9/1960 | Goldsholl | 229/21 |
| 2,966,293 | 10/1960 | Goldsholl | 229/16 |
| 3,145,898 | 11/1964 | Struble | 229/8 |
| 3,190,440 | 2/1965 | Palmer | 206/45.31 |
| 3,306,514 | 4/1967 | MacKenkrick | 229/17 |
| 3,343,743 | 7/1967 | Hamilton, Jr. et al. | 229/21 |
| 3,366,312 | 1/1968 | Lowenberg et al. | 229/62 |
| 3,381,877 | 3/1968 | Arneson | 229/21 |
| 3,447,672 | 6/1969 | Bailey et al. | 229/8 |
| 3,464,587 | 9/1969 | Edwards | 206/520 |
| 3,568,878 | 3/1971 | Fotos | 206/520 |
| 3,610,512 | 10/1971 | Hermallin | 229/32 |
| 3,630,430 | 12/1971 | Struble | 229/16 B |
| 3,637,130 | 1/1972 | Farquhar | 229/28 |
| 3,684,157 | 3/1972 | Mendez | 229/16 |
| 3,722,470 | 2/1973 | Farrell | 118/505 |
| 3,809,310 | 7/1974 | VanderLugt, Jr. | 229/26 |
| 3,820,684 | 6/1974 | Harrison | 206/520 |
| 3,845,897 | 11/1974 | Buttery et al. | 229/16 R |
| 3,877,632 | 4/1975 | Steel et al. | 229/41 B |
| 3,908,890 | 9/1975 | Baker | 229/37 R |
| 3,929,222 | 12/1975 | Smith et al. | 206/45.14 |
| 3,964,606 | 3/1976 | Hogg et al. | 206/395 |
| 3,982,683 | 9/1976 | Forteau | 229/17 R |
| 4,020,988 | 5/1977 | Kipp | 229/16 |
| 4,083,447 | 4/1978 | Walters et al. | 206/45.19 |
| 4,109,848 | 8/1978 | Kipp et al. | 229/21 |
| 4,169,539 | 10/1979 | Price | 220/410 |
| 4,185,764 | 1/1980 | Cote | 229/16 R |
| 4,222,598 | 9/1980 | Ulger | 294/1 B |
| 4,252,264 | 2/1981 | Herbst et al. | 229/1.5 B |
| 4,267,955 | 5/1981 | Struble | 229/16 R |
| 4,502,623 | 3/1985 | Moore et al. | 229/1.5 B |
| 4,552,293 | 11/1985 | Blagg et al. | 229/1.5 B |

FOREIGN PATENT DOCUMENTS

| | | | |
|---|---|---|---|
| 2316750 | 11/1973 | Fed. Rep. of Germany | 229/DIG. 14 |
| 1578742 | 7/1969 | France . | |
| 66428 | 4/1950 | Netherlands . | |
| 796271 | 6/1958 | United Kingdom . | |

*Primary Examiner*—Stephen Marcus
*Assistant Examiner*—Gary E. Elkins
*Attorney, Agent, or Firm*—Walt Thomas Zielinski

[57] ABSTRACT

A one piece blank is provided which may be erected into a generally hollow self-supporting food carton. The blank includes a base panel having first and second opposing score line edges, and first and second upright panels which are hingedly connected to corresponding scored edges of the base panel. The base panel also includes connecting side edges which extend between the opposing scored edges. Each upright panel includes bottom edge sections which extend outwardly from inwardly spaced locations on the connecting side edges. Cuts are provided which extend from the intersection of the connecting side edges and the bottom panel sections to the scored base panel edges. The carton is assembled by pivoting the first and second upright panels about the scored base edges, and attaching the upright panels at outwardly extending lateral edges. The arrangement and placement of cuts raises the base relative to the upright panels to provide arcuate supports for the carton.

3 Claims, 10 Drawing Figures

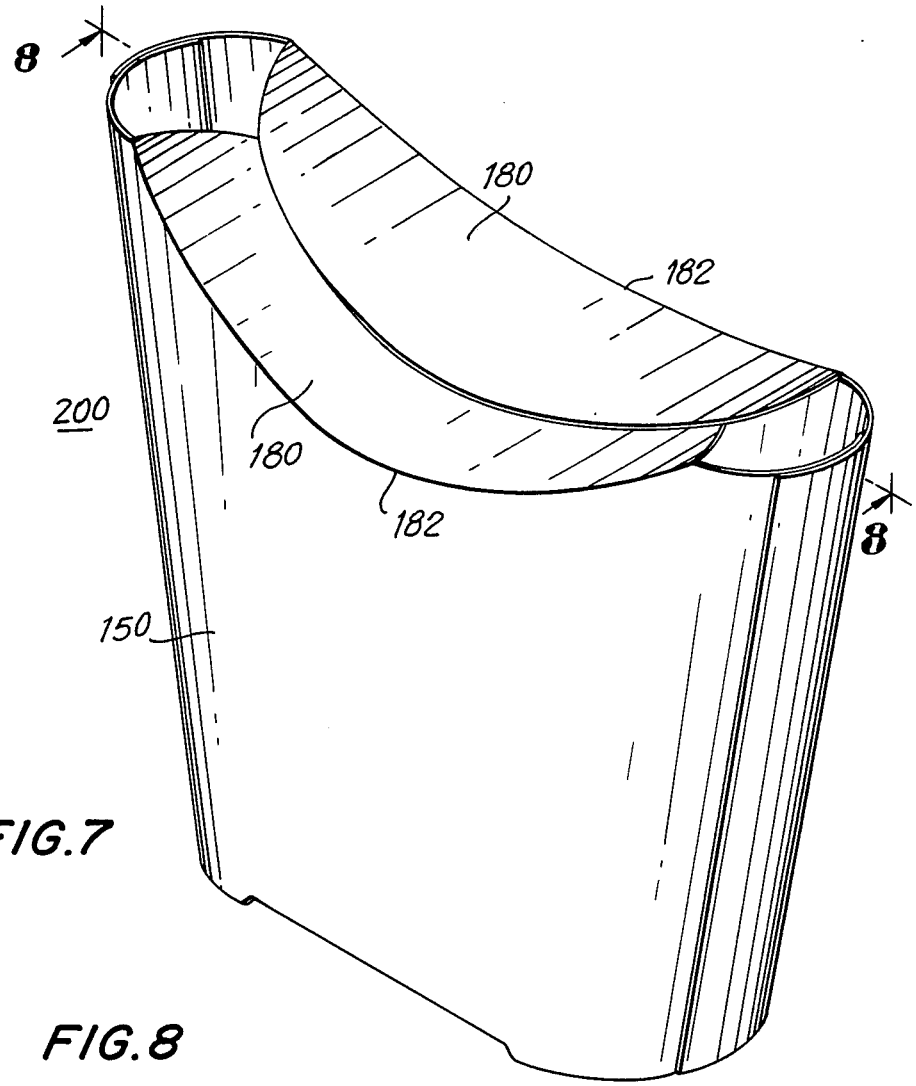
FIG.7
FIG.8
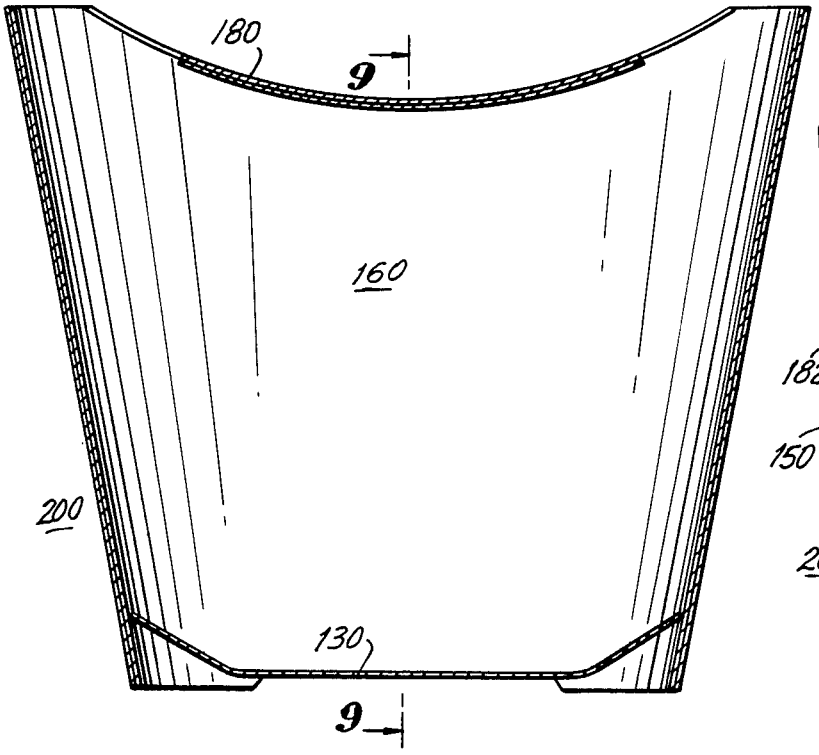
FIG.9
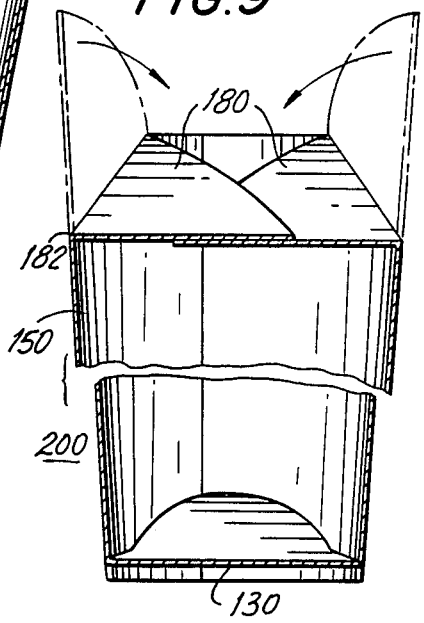

SELF-SUPPORTING AND SPILL RESISTANT FOOD CARTON

This application is a continuation of application Ser. No. 807,891 filed Dec. 11 1985 now abandoned.

DESCRIPTION

1. Technical Field

This invention relates generally to the art of folding paperboard cartons, and more particularly to cartons useable as food and beverage containers, blanks for their formation and processes for their manufacture and use.

2. Background Art

Cartons of the general type contemplated by the invention are basically well known and have been used for many years. Such cartons have found widespread use in restaurants, particularly those known as "fast food" restaurants for the dispensing of food such as french fried potatoes, meat, fish and poultry products. For purposes of accommodating their various applications, such cartons have been provided in a diversity of geometric configurations with both open and closed top end constructions. Carton constructions of this type are represented by U.S. Pat. No. 3,684,157 to Mendez and U.S. Pat. No. 4,267,955 to Struble.

The present invention is directed to an improved carton which has self-supporting, spill resistant as well as a more structurally sturdy construction than provided in the prior art. It will be appreciated that a carton structure with improved sturdiness and tilt tolerance is most desirable in "fast food" applications where containers are used for serving as well as packaging.

Accordingly, it is a broad object of the present invention to provide an improved food carton of economical design which is structurally sturdy.

A more specific object of the invention is to provide a food carton which has self-supporting and spill resistant features in a structurally uncomplex design.

DISCLOSURE OF THE INVENTION

In the present invention, these purposes, as well as others which will be apparent, are achieved generally by providing a blank which may be erected into a generally hollow upright non-collapsible, self-supporting carton. The carton blank includes a base panel having first and second generally opposing edges which are bordered by score lines, and first and second upright panels which are, respectively, hingedly connected to corresponding scored edges of the base panel. The base panel also includes connecting side edges which extend between the opposing scored edges. In the erected carton, the base panel forms a closed flat carton end, and the first and second upright panels, when secured together at opposing lateral edges, form the carton boundary wall.

Two features in the blank contribute to the structural integrity and sturdiness of the carton. Firstly, the first and second upright panels include bottom edge sections which extend outwardly from inwardly spaced locations on the connecting side edges. Secondly, cuts are provided in the bottom edge sections, extending from the intersection of the connecting side edges and the edge sections to the scored base panel edges. In the erected carton, the connecting side edges of the base are oriented inwardly relative to the base plane to provide stabilizing supports. Further structural rigidity in the carton is obtained by employing a base panel which has a greater longitudinal width than the base dimension of the carton. During assemblage of the carton this result is obtained by biasing lateral edges of the upright panels against connecting side edges of the base panel. A moisture venting feature is provided by recessing the connecting side edges into the carton to define openings between the base panel and upright panels. This recessed side edge arrangement also provides a shelf which facilitates separation of the cartons when they are stacked in nested relation.

In a preferred embodiment of the invention, the carton has an oval configuration, and the base panel has arcurate connecting side edges which are recessed into the carton at an approximately thirty degree angle. The oval configuration of the carton is maintained by outward pressure applied to the upright panels by the recessed edges. This effect is pronounced when the cartons are stacked in nested relation with supports in the cartons contacting and pressing downward on the side edges of underlying cartons. In this embodiment, the first upright panel is also provided with a wider longitudinal dimension than the second upright panel. The relative dimensions of the upright panels position connecting side seams in the carton offset towards the second upright panel for further carton stability.

In a further preferred embodiment of the invention, each upright panel is provided with a closure flap which flexes inwardly at upwardly opening arcuate score lines.

Other objects, features and advantages of the present invention will be apparent when the detailed description of the preferred embodiments of the invention are considered in conjunction with the drawings, which should be construed in an illustrative and not limiting sense, as follows:

BRIEF DESCRIPTION OF THE DRAWINGS

FIG. 7 is a perspective view of a carton formed from the blank of FIG. 6;

FIG. 8 is a vertical cross-sectional view of the alternative carton construction taken along the line 8—8 of FIG. 7;

FIG. 9 is a vertical cross-sectional view of the alternative carton construction taken along the line 9—9 of FIG. 8.

BEST MODE OF CARRYING OUT INVENTION

Figure 1:
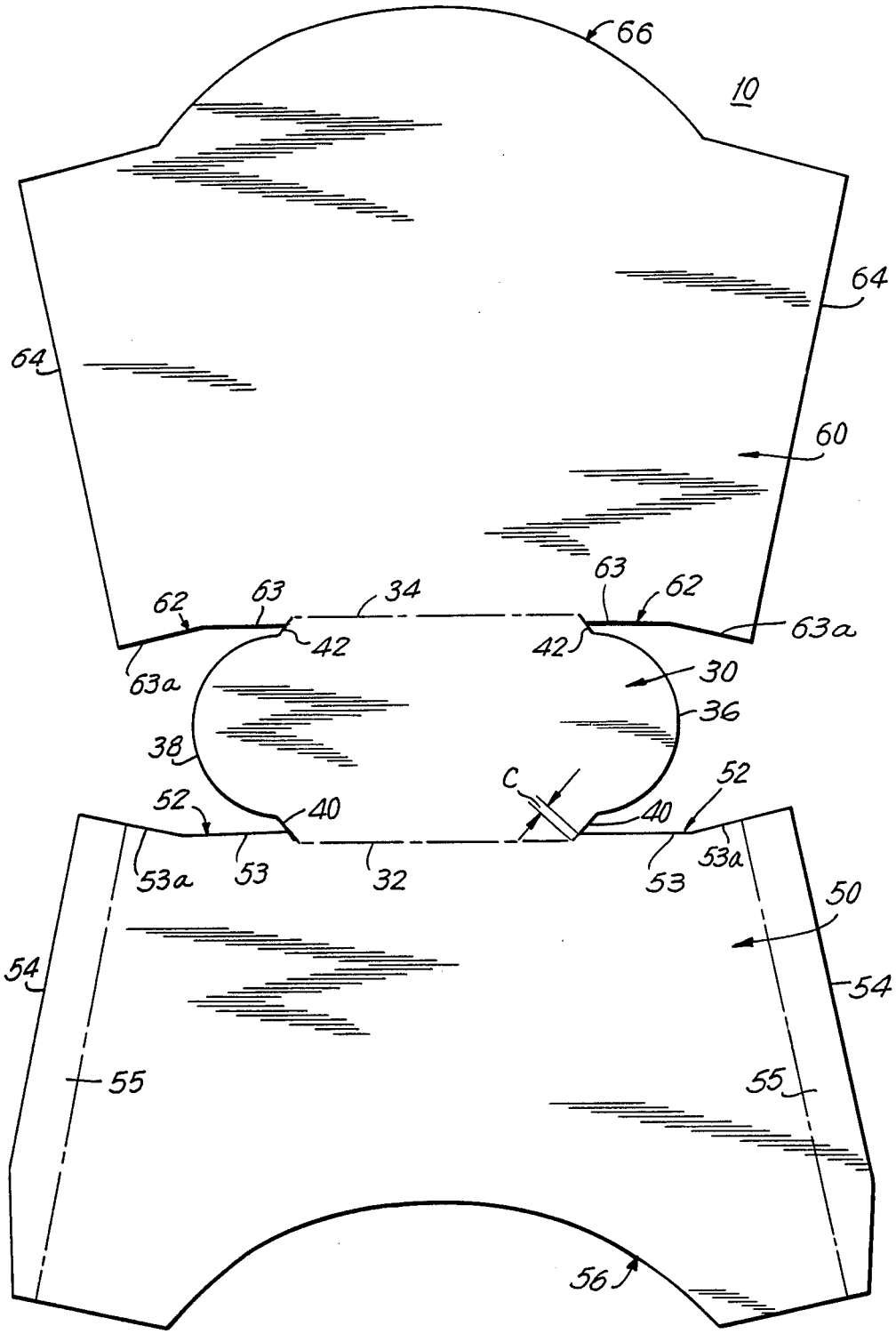
FIG. 1 shows a plan view of a blank cut and scored to form the carton of the present invention.

Referring now to the drawings, a blank and a self-supporting and spill resistant carton formed from the blank, respectively designated 10,20, are illustrated in FIGS. 1-5. The blank 10 comprises a base panel 30 which forms a closed end in the erected carton, and first and second upright panels 50,60 which form an enclosing boundary wall in the carton. For fast food applications, the carton blank is preferably fabricated of conventional folding carton paperboard in the 12 pt. to 16 pt. range and where appropriate grease resistant or laminated board.

The base panel 30 includes first and second opposing edges 32,34 which are bordered by score lines, and connecting side edges 36,38 which have an outwardly oriented arcuate configuration. Each connecting side terminates in angled legs 40,42 which respectively meet the first and second opposing edges 32,34 of the base panel.

The first and second upright panels 50, 60 each include bottom edges 52,62, a pair of opposing lateral edges 54,64 which extend outwardly from the bottom edge, and top end edges 56,66.

Each bottom panel edge 52,62 includes opposing sections 53,63 which extend outwardly from respective connecting side legs 40,42 of the base panel 30. For reasons which will be discussed hereinafter, the panel sections 53,63 are spaced substantially like distances inwardly from scored base panel edges 32,34, and provided with cuts, designated by the letter C in FIG. 1, which extend from the intersection of legs 40,42 and bottom panel sections 53,63 to scored base panel edges 32,34. At their exterior ends, bottom panel edges 52,62 are provided with inwardly angled sections **53*a*, 63*a*** for purposes which will also be discussed below.

FIGS. 2–5 show the blank of FIG. 1 erected to form a generally oval non-collapsible container 20 with a closed bottom end and open top end. As may be seen with reference to FIG. 1, the first upright panel 50 includes areas designated 55 which receive glue or other conventional adhesive for securing the first and second upright panels 50,60 together at opposing lateral edges 54,64. It will be appreciated that upright panels 50,60 pivot about score lines 32,34 to facilitate construction of the flat bottom carton 20. According to an important feature of the invention, the bottom edges 52,62 of the upright panels project outwardly from base panel 30 to provide arcuate supports 70, best shown in FIG. 3. Arcuate supports 70 result from the arrangement of cut scores C which cause the bottom edges 52,62 of the upright panels 50,60 to be spaced downwardly relative to the base panel 30 when the carton is erected. Inwardly angled section **53*a*, 63*a* of the upright panel bottom edges further contribute to define the arcuate supports 70 by depending downwardly below base panel 30 in the erected carton, see FIG. 4**.

Figure 3:
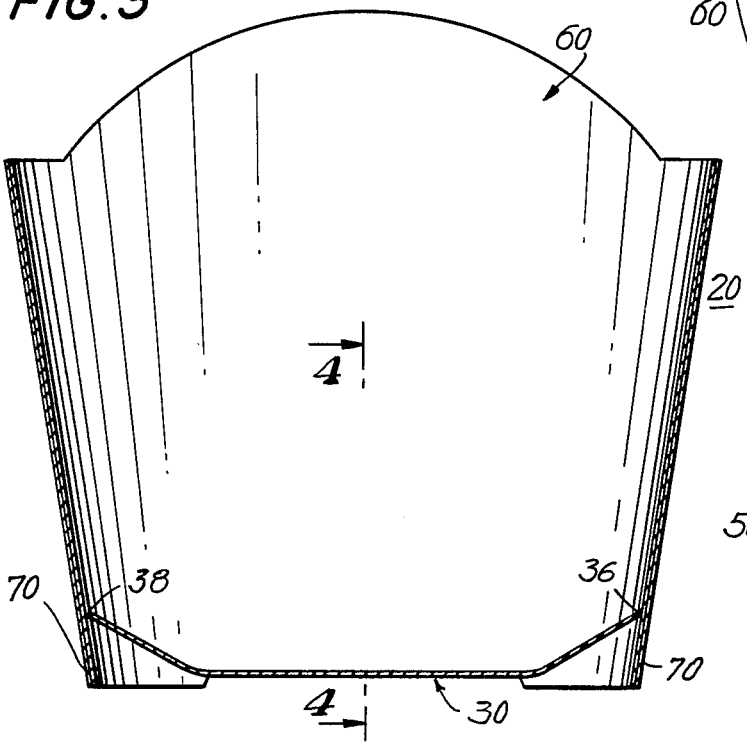
FIG. 3 is a vertical cross-sectional view of the carton taken along the line 3—3 of FIG. 2.
Figure 4:
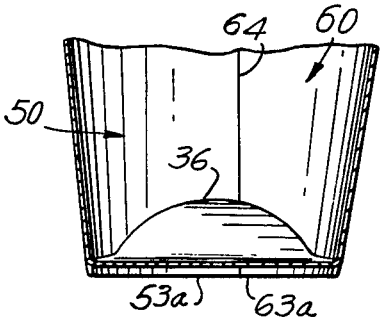
FIG. 4 is a vertical cross-sectional view of the carton taken along the line 4—4 of FIG. 3.

Further structural rigidity in the carton 20 is obtained by dimensioning the erected carton so that it has a longitudinal width in its base area, which is smaller than the width of base panel 30, thereby biasing opposing lateral edges 54,64 of the upright panels against connecting side edges 36,38 of the base panel 30. As best shown in FIG. 3, the side edges 36,38 are recessed into the scoop on approximately a thirty degree angle to provide openings **36*a*, 38*a* between the base panel 30 and upright panels 50,60. It will be recognized that the orientation of the angled legs 40, 42 relative to opposing edges 36, 38 of the connecting sides define the vent openings 36*a*, 38*a*, see FIG. 5**. These openings provide venting channels from the bottom to top of the carton, allowing hot moist air to escape and maintain the crispness of packaged foodstuffs.

Still further advantage is obtained by providing the first upright panel 50 with a wider longitudinal dimension than the second upright panel 60. The relative dimensions of the upright panels position connecting side seams 74 offset towards the second upright panel 60 for enhanced carton stability.

Figure 2:
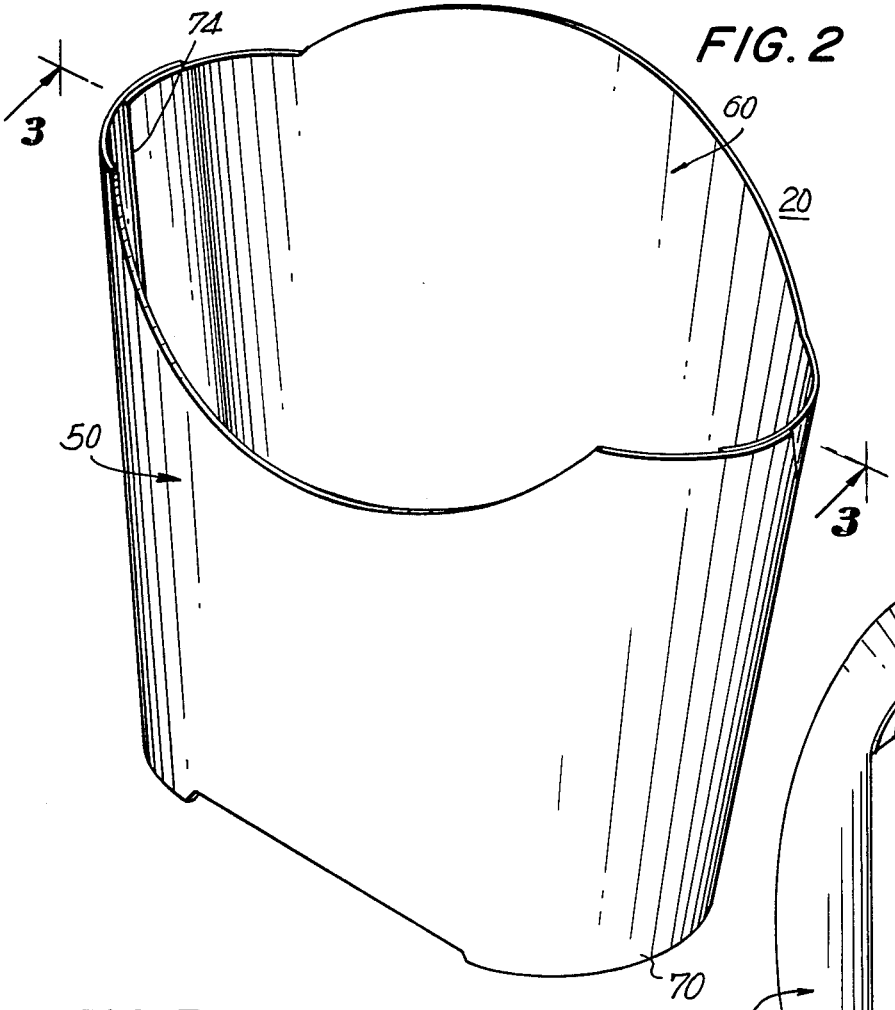
FIG. 2 is a perspective view of a carton formed from the blank of FIG. 1.
Figure 5:
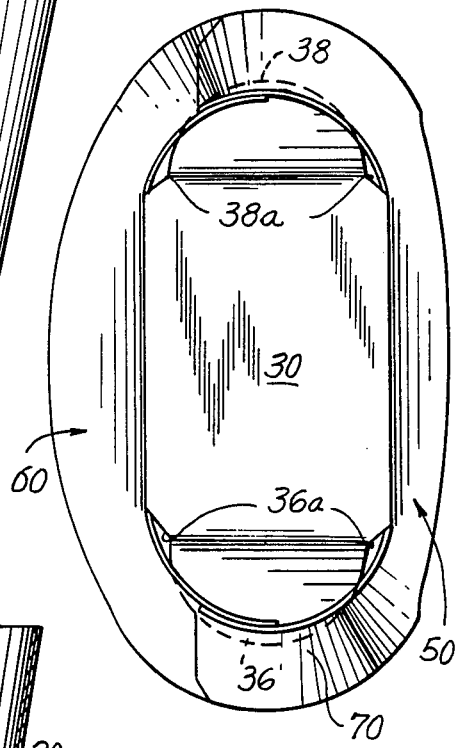
FIG. 5 is a plan view of the closed end of the carton of FIG. 2.
Figure 10:
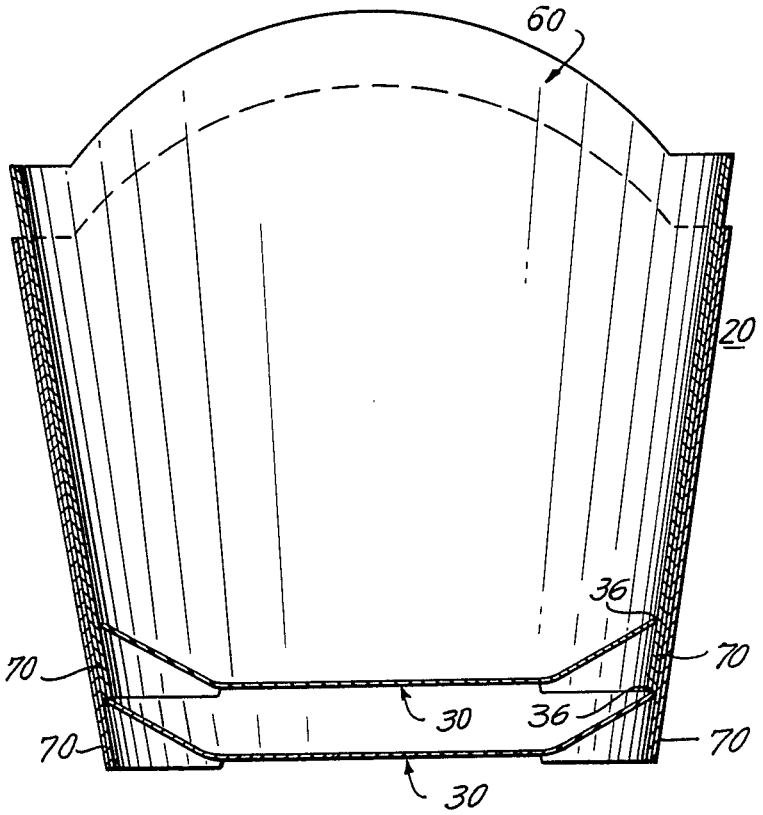
FIG. 10 is a vertical cross-sectional view of cartons, according to the embodiment of FIG. 2, arranged in nested relation.

In practice the carton 20 is provided to the consumer in the erected form illustrated FIG. 2. Its oval configuration, and outwardly tapered side walls facilitate storage in stacked or nested fashion, and ready separation for use, see FIG. 10. In this connection, it will be appreciated that recessed side edges 36, 38 define a shelf which facilitates separation of stacked cartons.

The recessed side edges also exert outward pressure on the upright panels 50, 60 to maintain the oval configuration of the carton. This effect is pronounced when the cartons are stacked in nested relation with the supports 70 of each carton contacting and pressing downward on the side edges 36, 38 of an underlying carton. It will be appreciated that provision of a base panel 30 which is wider than the longitudinal dimension of the carton base, and the downward pressure applied to the side edges 36, 38 by the nesting arrangement coact to maintain the side edge edges at approximately thirty degree angles.

Figure 6:
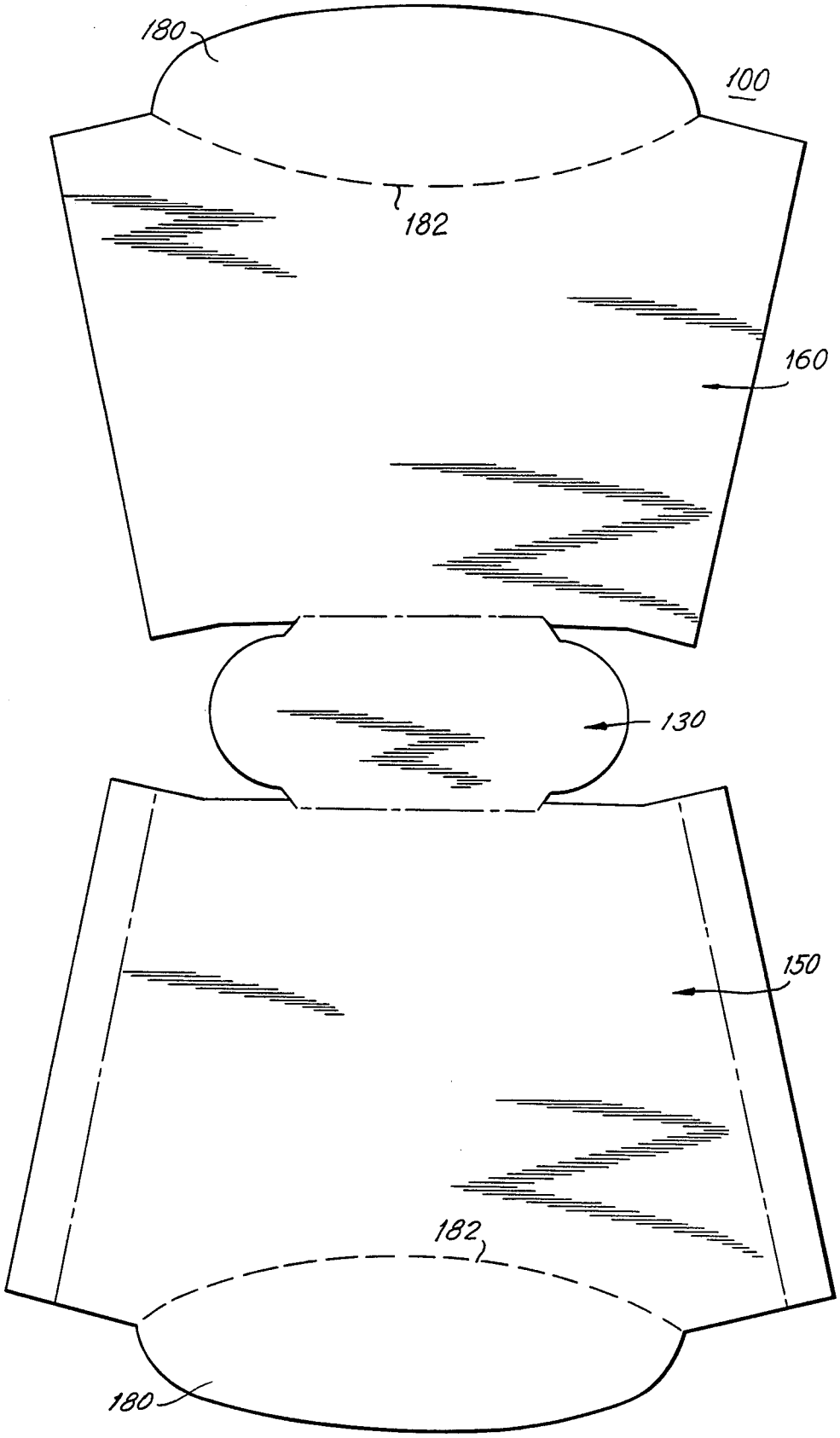
FIG. 6 is a plan view of an alternative blank cut and scored to form a carton which includes closure flaps.

FIGS. 6–9 illustrate an alternative blank embodiment, designated 100, for forming a self-supporting and spill resistant container 200 in accordance with the invention. Referring to FIG. 6, it will be seen that the blank includes a base panel 130 and first and second upright panels 150,160, corresponding to the arrangement of FIG. 1. This alternative embodiment of the invention differs in the provision of closure flap panels 180 which are joined to the first and second upright panels 150,160 at inwardly scalloped or arcuate score lines 182.

In the erected carton 200, illustrated in FIGS. 7–9, it is seen that closure flap panels 180 flex inwardly to provide closure flaps. Advantageously, the closure functions to prevent spillage as well as insulate the carton against heat loss.

From the foregoing, it will be appreciated that the present invention provides a food carton which achieves the objectives stated heretofore. In particular, a food carton construction is provided which is sturdy and durable, and which may be readily erected from a one piece carton blank. Advantageously, improved sturdiness and spill resistance in the carton is obtained by providing arcuate supports 70 which stabilize the carton. In this connection upright panels 50,60 are provided with inwardly angled sections **53*a*, 63*a* which depend downwardly from base panel 30 in the erected carton. Further sturdiness in the carton is obtained by biasing the base panel connecting edges 36, 38 against the upright panels when erecting the carton. Recessing side edges 36,38 into the carton provides openings 36*a*, 38*a* for venting moisture and defines a shelf which facilitates separation of nested cartons. The recessed side edges also exert outward pressure on the upright panels 50, 60** to maintain the oval configuration of the carton.

Numerous modifications are possible in light of the above disclosure. For example, the drawings show closure flaps 180 which partially close the top end of the container 200. It will be appreciated that the construction of the closure flaps may vary to provide for full carton closure or to incorporate vent openings. In similar manner, although the cartons 20, 200 are illustrated as having generally oval configurations, other geometric configurations are within the scope of the disclosure. It is to be understood, therefore, that the above-described embodiments are merely illustrative, and other embodiments may be devised by those skilled in the art, without departing from the spirit or scope of the present invention, as set forth in the appended claims.

We claim:

1. A one piece blank which may be erected into a generally hollow non-collapsible upright self-supporting carton which is storable in a nested and stacked arrangement, comprising:

a base panel which forms a closed flat end in erected carton, said base panel including first and second generally opposing edges each bordered by a score line, and generally arcuate connecting side edges, said first and second scored edges being formed by generally parallel spaced lines;

first and second upright panels respectively hingedly connected to said first and second scored edges, said first upright panel having a greater longitudinal width than said second upright panel, said first and second upright panels each including, a bottom edge, a pair of opposing lateral edges extending outwardly from said bottom edge, and a top end edge which connects said lateral edges;

each bottom edge including opposing sections which intersect and extend outwardly from said connecting side edges of the base, said sections being spaced substantially like distances inwardly from said scored base panel edges, and provided with cuts which extend from the intersection of said connecting side edges and said sections to said scored base panel edges, said cuts being contiguous to said connecting edges;

said first and second upright panels being pivoted about said scored base panel edges, and said lateral edges of said panels, respectively, being attached to form the upright carton;

said connecting base panel edges being recessed within the carton at an approximately thirty degree angle and biased against said first and second upright panels to enhance the structural integrity and maintain the configuration of the carton;

said recessed connecting base panel edges defining a shelf which facilitates storage and separation of cartons when stacked in nested relation;

said connecting base panel edges also defining vent openings between said base panel and said upright panels;

said bottom edge sections raising said closing flat carton end relative to said upright panels to provide supports and a self-standing carton feature;

said supports also enhancing the structural integrity of the carton when a plurality of such cartons are stacked in nested relation, said supports of each carton contacting and pressing downward on the side edges of an underlying carton to maintain the configuration of the cartons.

2. A blank according to claim 1, wherein the carton has a substantially oval cross-section.

3. A blank according to claim 1, wherein said first and second upright panels include hingedly connected closure flap panels.

* * * * *